United States Patent [19]

Regis

[11] Patent Number: 4,480,836

[45] Date of Patent: Nov. 6, 1984

[54] BOARD GAME

[76] Inventor: Helmut A. Regis, P.O. Box 43, Station "S", Toronto, Ontario, M5M 1L6, Canada

[21] Appl. No.: 501,446

[22] Filed: Jun. 6, 1983

[51] Int. Cl.[3] ..... A63F 3/00

[52] U.S. Cl. ..... 273/248

[58] Field of Search ..... 273/248, 242, 243, 236, 273/238, 260, 261, 262; D21/24, 34

[56] References Cited

U.S. PATENT DOCUMENTS

| | | | |
|---|---|---|---|
| 1,061,999 | 5/1913 | Grondahl | 273/269 |
| 1,279,691 | 9/1918 | Hayes | 273/258 |
| 1,633,445 | 6/1927 | Gail et al. | 273/272 |
| 2,133,515 | 10/1938 | Horton, Jr. | 273/242 |
| 2,750,193 | 6/1956 | Wales | 273/248 |
| 2,791,430 | 5/1957 | King | 273/236 |
| 2,798,728 | 7/1957 | Wales | 273/258 |
| 3,399,895 | 9/1968 | Beach | 273/241 |
| 3,633,913 | 1/1972 | Solimene | 273/248 |
| 4,093,237 | 6/1978 | Weiss | 273/260 |
| 4,256,309 | 3/1981 | McQuillan | 273/258 |

FOREIGN PATENT DOCUMENTS

| | | | |
|---|---|---|---|
| 1165826 | 10/1958 | France | 273/236 |
| 67266 | 2/1914 | Switzerland | 273/242 |

*Primary Examiner*—Richard C. Pinkham
*Assistant Examiner*—Scott L. Brown
*Attorney, Agent, or Firm*—W. Dennis Moss; Peter R. Hammond

[57] ABSTRACT

A kit for playing a game including a game board having at each corner four large squares, each of which is divided into a number of small, numbered squares of equal size. The large squares are of equal size and have the same number of small squares. Two of the large squares are checkered while the other two are of uniform but different colors. The game kit includes a first set of game pieces of a first colored numbered from one to a number equal to the number of small squares in each large square. A second set of game pieces of a second color is numbered from one to the same number as the first set. There are also provided two dice for randomly determining two numbers in the range from one to six. Preferably the number of game pieces in each set is thirty-six and the game pieces are flat, square pieces having horizontal dimensions corresponding to those of the small squares. A further set of game pieces that are unnumbered can be provided as option chips.

11 Claims, 5 Drawing Figures

BOARD GAME

BACKGROUND OF THE INVENTION

This invention relates to board games and in particular to games suitable for two players or two teams of players.

Various games are presently known that employ a checkered, square game board and sets of playing pieces. Perhaps the two most widely played games of this type are the game of checkers and the game of chess, the two of which employ essentially the same game board. In checkers, the square board or playing surface is divided into sixty-four small squares of equal size, which small squares are coloured in checkerboard fashion. Each of the two players has twelve playing pieces, each of which is in the shape of a round disc. The object of the game is to remove all of the opponent's players without losing all of your own players.

In the game of chess, there are several different types of game pieces. Thus each player has eight pawns, two castles, two bishops, two knights, a queen and a king. The manner in which a player can move a game piece on the board depends upon the type of game piece. Again the object of the game of chess is to remove or "take" the other player's men or game pieces without losing all of your own men.

Games that employ a game board having multiple, square playing surfaces are also known. For example U.S. Pat. No. 1,633,445 issued June 21, 1927 to W. W. Gail et al teaches a game board having a large square in each of the four corners of the board. Each of these squares is divided into thirty-six smaller squares that form a checkerboard pattern. The board is used in conjunction with square players or game pieces. The game pieces are provided with one or two letters printed on each. Apparently various rules can be used to govern the manner of play. All of the white squares in each larger square are marked with one or two arrows and none of the squares on the board are numbered.

An early U.S. patent that discloses the use of four rectangular playing areas that are divided into numbered squares is U.S. Pat. No. 1,061,999 issued May 20, 1913 to E. L. Grondahl. The small squares in each of the rectangular areas are numbered from one to twenty. The game is played with counters having faces coloured so that they correspond to the playing fields or rectangular areas and these counters are numbered. The four rectangular areas are arranged along the four sides of a central, square, plain field. When playing the game, the counters are not arranged on the rectangular fields but are placed in a bag or receptacle in order that they may be drawn by each player during his turn.

U.S. Pat. No. 2,228,180 issued Jan. 7, 1941 to H. I. Pauli describes a game board that is divided into squares with each square having four numbers printed thereon. The square game pieces also have four numbers printed thereon. The object of the game is to arrange the game pieces on the squares so that the adjacent numbers of adjacent game pieces will correspond to one another.

An early U.S. patent which employs only a single square playing surface, which surface is divided into thirty-six smaller squares, is U.S. Pat. No. 869,316 issued Oct. 29, 1907 to M. Maris. In this patent the small squares are numbered from one to thirty-six with the number one appearing in the upper left hand corner and the numbers running horizontally from left to right and then right to left. The game is played with thirty square game pieces, each of which has edges with colours, characters or figures matchable one with another at two or more of the sides or spaces.

It is an object of the present invention to provide a novel board game that can be played by two persons or two teams and that provides a real challenge to the players.

It is a further object of the present invention to provide a board game wherein the board has four square fields, each divided into a number of smaller squares of equal size, and there are two sets at least of game pieces with each set being numbered from one to a number equal to the number of small squares in each of the four square fields.

It is another object of the present invention to provide a game wherein the object of the game is for each player to be the first to move his game pieces from two square fields having a checkerboard pattern to a square field of a uniform colour corresponding to that of his game pieces.

SUMMARY OF THE INVENTION

According to the present invention, a game apparatus comprises the combination of a game board having four large squares each divided into a number of small numbered squares of equal size. The large squares are of equal size and have the same number of small squares. Two of the large squares are checkered and the other two are of uniform but different colours. A first set of game pieces of a first colour is numbered from one to a number equal to the number of small squares in each large square. A second set of game pieces of a second colour is numbered from one to the same number as the first set. Further there is provided means for randomly determining two numbers in the range from one to six inclusive.

Preferably the game apparatus has each large square located at a respective corner of the board. Further there are thirty-six small squares in each large square and thirty-six numbered game pieces in each of the first and second sets. The determining means can comprise two regular dice.

In one preferred embodiment of the game board disclosed herein, one of the large squares of uniform colour is coloured the same colour as the first set of game pieces and the other of the large squares of uniform colour is coloured the same as the second set of game pieces.

A preferred embodiment of the present invention will now be described, by way of example, with reference to the accompanying drawings.

DETAILED DESCRIPTION OF PREFERRED EMBODIMENT

Figure 1:
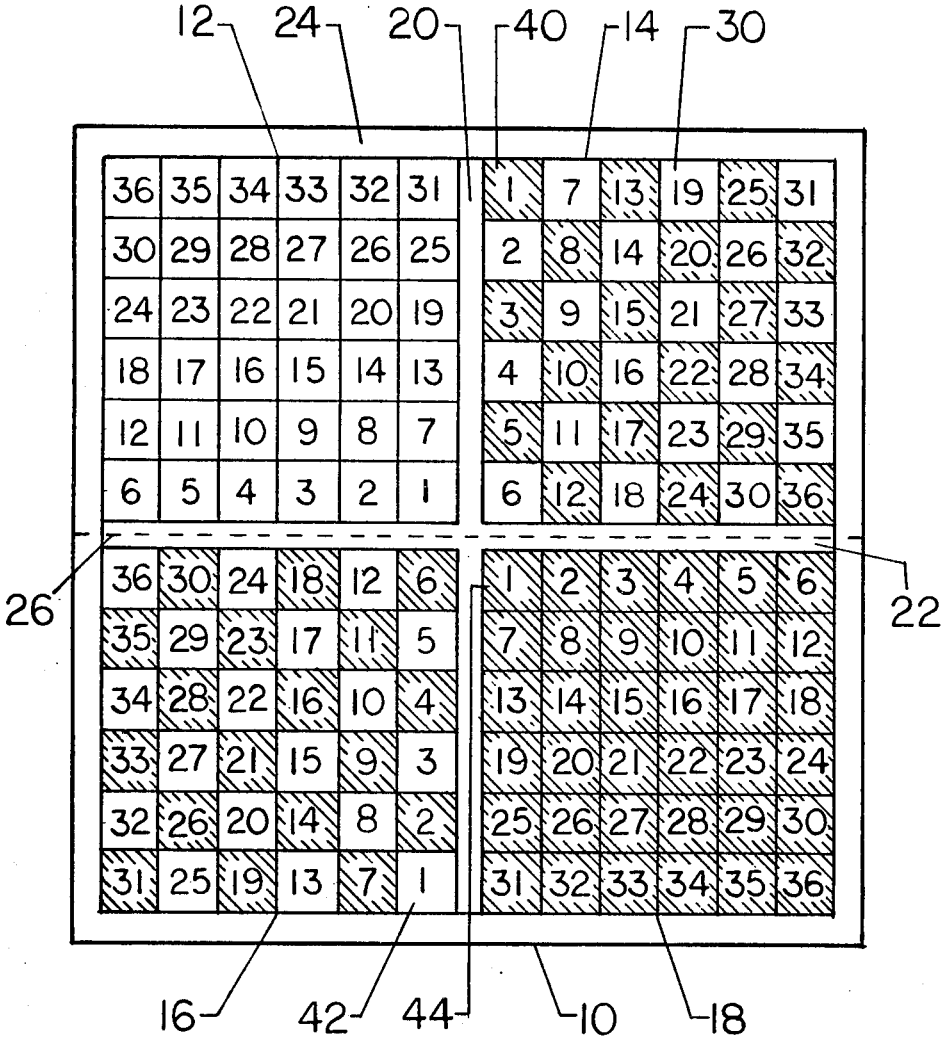
FIG. 1 is a plan view of a game board constructed in accordance with the present invention.

As shown in FIG. 1 a game board 10 has four large squares drawn, printed, or otherwise formed thereon, which squares are designated 12, 14, 16 and 18. These large squares are separated by vertical and horizontal gaps 20 and 22. In the preferred embodiment as shown, there is also a border area 24 extending about the perimeter of the board. In the preferred embodiment shown, there is one large square at each of the four corners of the square game board 10. As can be seen each of the squares substantially fills one-quarter of the area of the game board.

The game board 10 can be constructed in any conventional manner and with conventional materials such as cardboard, plastic, and wood. In order to make the game board smaller for transport or storage, it may be divided into two sections along a fold line indicated by the dashed line at 26. The actual, overall size of the game board can vary, depending upon the particular requirements of the user and the size of the playing pieces that are to be used on the board. In one preferred embodiment, the board 10 measures 12 inches by 12 inches measured between the outer corners of the playing surfaces.

It will be noted that the four large squares 12, 14, 16 and 18 are of equal size and they are each divided into a number of small, numbered squares 30. In the illustrated preferred embodiment there are thirty-six small squares of equal size in each of the large squares with the small squares being arranged in six rows with six squares in each row. However it should be appreciated that a game in accordance with the present invention could be played with a game board having fewer or more small squares 30 in each of the large squares. For example there could be twenty-five small squares in each large square with the twenty-five squares forming five rows of five squares each. However if fewer than thirty-six or more than thirty-six small squares are provided in each large square, the rules of the game as discussed hereinafter might require some modification in order to accommodate the difference in the game board.

Each of the four groups of small squares 30 is numbered from one to thirty-six in the illustrated preferred embodiment. However the manner in which each group of small squares 30 is numbered varies from one large square to the next. With reference to the upper left large square 12, it will be seen that the small square 30 numbered one appears in the bottom right hand corner and the numbers run horizontally from right to left in the square 12. However in the upper right large square 14, the small square 40 which bears the numeral one appears in the upper left corner of the large square. The numbers then run vertically from top to bottom with the square numbered seven appearing to the right of the square bearing the number one. In the lower left large square 16, the small square 42 bearing the number one appears in the bottom right corner and the numbers run vertically from bottom to top. Thus the square with the number seven appears to the left of square 42. In the lower right square 18, the small square 44 which bears the number one appears in the upper left corner of the large square and the numbers run horizontally from left to right.

Another significant aspect of the game board 10 is the colouring of the squares that appear on the board. In particular it will be noted that the large squares 14 and 16 which are diagonally opposite one another are checkered while the other two large squares 12 and 18 are of uniform but different colours. Normally one of the two colours is white and the other colour is preferably a contrasting colour such as black or brown. For purposes of the present description, the large square 12 will be considered as coloured white while the large square 18 will be considered as coloured black. The checkered squares 14 and 16 have alternating white and black small squares 30. It should be particularly noted that the small squares 30 bearing the same number in the large squares 14 and 16 are of opposite colours. Thus the square at 40 is black while the square at 42 is white. Of course the colours of these squares could be switched with the colour of square 40 being white and the colour of square 42 being black.

Figure 2:
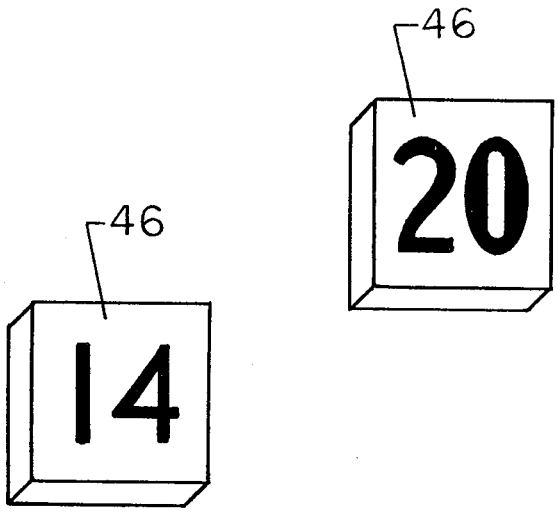
FIG. 2 is a perspective view showing two of the numbered game pieces used in association with the game board of FIG. 1.
Figure 4:
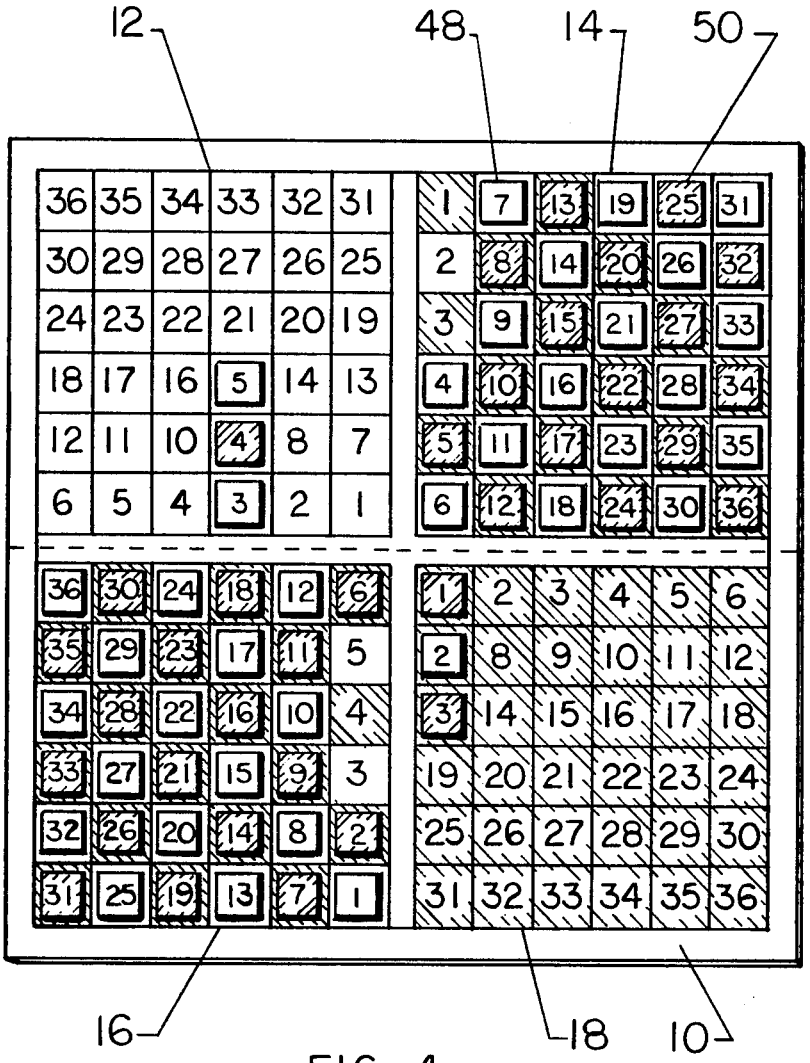
FIG. 4 is a plan view of the game board with seventy-two game pieces arranged thereon.

The game of the present invention comes equipped with first and second sets of game pieces 46, two of which can be seen in FIG. 2. The preferred illustrated game piece is square and flat and has a number from one to thirty-six appearing on the top surface thereof. These game pieces can be constructed in any well known manner from plastic, wood or metal. The horizontal dimensions of the game piece or tile should correspond to those of the small squares 30 or should be slightly smaller. The game piece should be sufficiently thick to permit a player to easily pick up the piece and move it to another position. The game pieces shown in FIG. 4 are slightly smaller than the squares 30. Instead of square game pieces, round ones could also be used in which case the diameter should not exceed the dimensions of the squares 30.

In the preferred illustrated embodiment each set of game pieces comprises thirty-six pieces in all. In FIG. 4 the first set 48 comprises white game pieces while the second set 50 comprises black game pieces. All thirty-six game pieces of each set are shown in FIG. 4. At the start of the game the game pieces are placed on their matching squares in the starting areas which comprise the checkered large squares 14 and 16. Thus the black game piece bearing the number six for example is placed on the black square bearing the number six in the large square 16. Similarly the white game piece bearing the number six is placed on the white square bearing the number six in the large square 14. In FIG. 4 all of the game pieces appear in their proper starting positions except for the black game pieces bearing the numbers one, three and four and the white game pieces bearing the numbers two, three and five, which game pieces have been moved from their initial starting position.

Figure 5:
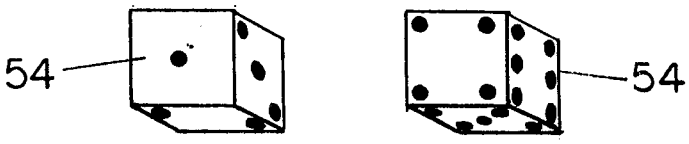
FIG. 5 is a perspective view of the standard dice that can be used to play a game on the board of FIG. 1.

In addition to the aforementioned game board and game pieces, there is provided means for randomly determining two numbers in the range from one to six inclusive. The preferred determining means comprises two regular dice 54 in the form shown in FIG. 5. These dice either bear dots or numerals on each of their six sides so that when they are rolled they will indicate any one of the numbers from one to six by the reading on the top face. As indicated hereinafter, two dice are normally used so that two separate numbers from one to six will be indicated with each roll.

Figure 3:
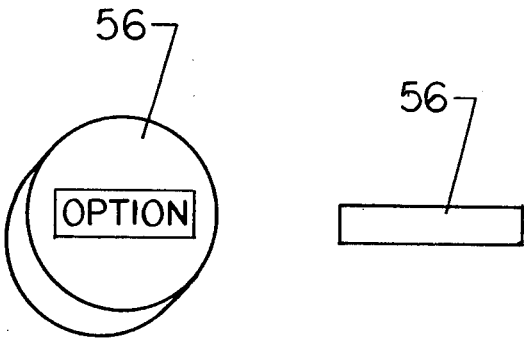
FIG. 3 is a view of two option chips that are used with the preferred embodiment of the invention, one of these chips being shown edgewise and the other in perspective.

Preferably the game also comes with "option" chips or game pieces 56 two of which are shown in FIG. 3. Preferably these chips or game pieces have either a different shape or different colour than the regular game pieces of sets 48 and 50 so that they can be readily distinguished. If desired, they can also be labelled with the word "option" which indicates the purpose of these chips as explained hereinafter. The preferred number of "option" chips is twenty but less chips or more chips could be provided with the game. Instead of using these "option" chips, the number of option moves or turns available to a particular player could be kept track of by means of a simple written record if desired. One or both of the two players could keep the required written record. Each time a player acquires the right to an option, a check mark or a stroke could be placed beside the player's name. When one of these options is used, the check mark or line could be struck out by the player keeping the record.

RULES OF PLAY

In order to play a game with the apparatus of the present invention, the game pieces of each set 48 and 50 are arranged in their starting positions as described above. The players can then decide who goes first by rolling the dice. The player who rolls the highest number can take the first turn. A turn consists of one or more "moves". A single "move" comprises picking up three adjacent game pieces located in a vertical or horizontal row in any of the four playing areas or squares 12, 14, 16 and 18. The playing pieces must be placed in any of the four playing areas where empty spaces 30 are available in the same order and in a horizontal or vertical row. If the three pieces are initially arranged in a vertical row, then they must be placed back onto the game board in a vertical row. Similarly if they are initially arranged in a horizontal row, they must be placed back in a horizontal row.

At the beginning of a player's turn, he must toss the two dice to determine how many of the aforementioned moves he will be allowed to take that turn. The most moves allowed in any turn are four regardless of the numbers shown on the dice. Omitting the possibility of a "double most moves allowed in any turn are four regardless of the numbers shown on the dice. Omitting the possibility of a "double" combination being shown on the dice, the following list shows how many moves will be permitted in a single turn with a certain dice combination:

| Numbers Shown on Dice | Number of Moves Permitted |
|---|---|
| 1 + 2 | Two |
| 1 + 3 | Three |
| 1 + 4 | Four |
| 1 + 5 | One |
| 1 + 6 | One |
| 2 + 3 | Three |
| 2 + 4 | Four |
| 2 + 5 | Two |
| 2 + 6 | Two |
| 3 + 4 | Four |
| 3 + 5 | Three |
| 3 + 6 | Three |
| 4 + 5 | Four |
| 4 + 6 | Four |
| 5 + 6 | Player Loses Turn |

It will be seen from the above mentioned chart that a die showing a number five or the number six will be ignored for purposes of determining how many turns a player is entitled to. Otherwise the rule is that the number of turns will be determined by the highest number shown on the two dice. Thus for example with a dice combination of two and four, a player will be entitled to four moves as this is the maximum number shown on one of the two dice. If the combination five and six is shown on the dice, the player will lose his turn completely.

If the dice both show the same number, that is a double, then the player will have three choices available to him for that turn. These choices are the following:

(1) He may make four of the aforementioned moves during that turn;

(2) He may make only one move in which he will be permitted to move a single tile or game piece by itself; and (3) He may pick up an option chip for subsequent use and make no move at all during that turn.

It should be noted here that a player is allowed to pick up and place either his own or his opponent's game pieces in any of the four playing areas 12, 14, 16 and 18. In some cases it may be necessary for him to pick up a combination of his own and his opponent's game pieces. The exception to this general rule occurs when the opponent's playing pieces are in the opponent's "finishing area" and are positioned on the correct small squares 30 in an unbroken sequence beginning with his piece No. 1. A player can move his opponent's pieces even in the opponent's "finishing area" provided these pieces do not form part of a continuous sequence that begins at square No. 1. If the two colours of the game board and the game pieces are white and black, then the finishing area for the player having white game pieces is the area of square 12 while the finishing area of the player with the black game pieces is the square 18.

The object of the game played with the game kit of the present invention is for each player to place all of his game pieces on the appropriate squares in his finishing area first. As points will be scored for each tile or game piece placed correctly, it is possible to still determine a winner even if neither player places all of his game pieces on the appropriate squares by the end of the game. Points are only scored by a player for those tiles placed correctly beginning with playing piece number one and continuing in numerical order to the last game piece in a continuous sequence which is placed correctly. All other game pieces do not score points, even if they are located on their proper squares in the finishing area.

Turning now to the use of the "option chip", an option chip which a player has in his possession at the beginning of a turn can be used during that turn or any subsequent turn. If he decides to use one of his option chips, he must give up that chip and select one of the three following options that are available to him:

(1) He can move a single tile by itself, in which case he does not throw the dice during his turn and has no further moves;

(2) He may toss the dice in the usual manner and have the usual number of turns designated by the dice and in addition he will have the opportunity to move a single tile by itself. However if he selects this option and he throws a double with the dice or a five and six combination, the player will lose his turn; and (3) He may make four moves during that turn with each move involving the picking up and placement of three game pieces in the usual manner. Again, if the player chooses this option, he does not throw the dice at the beginning of the turn.

It will be obvious to those skilled in the art of producing games that various modifications and changes could be made to the game apparatus or kit as described without departing from the spirit and scope of this invention.

The applicant intends that all such modifications and changes that fall within the scope of the appended claims be part of his invention. For example, instead of using standard dice to select numbers from one to six, the numbers could be selected by a "spinner" in the form of a pointed arrow or rod adapted to spin about its longitudinal center over a field divided into sections numbered one to six. Also the game board 10 could be rearranged to a considerable extent without departing from the spirit and scope of the invention. For example the two finishing areas could be placed side by side at the bottom of the board and the starting areas placed side by side at the top.

What I claim as my invention is:

1. A game apparatus comprising the combination of a game board having four large squares each divided into a number of small numbered squares of equal size, the large squares being of equal size and having the same number of small squares, two of said large squares being checkered and the other two being of uniform but different colours, a first set of game pieces of a first colour numbered from one to a number equal to the number of small squares in each large square, a second set of game pieces of a second colour numbered from one to the same number as said first set, and means for randomly determining the number of moves to which a player is entitled.

2. A game apparatus according to claim 1 wherein each large square is located at a respective corner of the board and there are thirty-six small squares in each large square and thirty-six numbered game pieces in each of said first and second sets.

3. A game apparatus according to claim 2 wherein said determining means comprise two regular dice.

4. A game apparatus according to claim 2 wherein the small squares in each large square are numbered consecutively from one to thirty-six.

5. A game apparatus according to claim 4 wherein in the upper, left large square, the small square numbered one appears in the bottom right corner of the large square and the numbers run horizontally from right to left; in the upper, right large square, the small square numbered one appears in the upper left corner of the large square and the numbers run vertically from top to bottom; in the lower, left large square, the small square numbered one appears in the bottom right corner of the large square and the numbers run vertically from bottom to top; and in the lower, right square, the small square numbered one appears in the upper, left corner of the large square and the numbers run horizontally from left to right.

6. A game apparatus according to claim 2 wherein the large checkered squares are diagonally opposite one another and the large squares of uniform colour are diagonally opposite one another.

7. A game apparatus according to claim 1 wherein one of said large squares of uniform colour is coloured the same colour as said first set of game pieces and the other of said large squares of uniform colour is coloured the same as said second set of game pieces.

8. A game apparatus according to claim 1 wherein each game piece is a flat square piece having horizontal dimensions corresponding to those of said small squares.

9. A game apparatus according to claim 1 including a further set of game pieces that are unnumbered, said further set being of uniform colour, size, and shape.

10. A game apparatus according to claim 1 including a further set of unnumbered game pieces, said further set totalling twenty in all.

11. A game apparatus according to claim 1 wherein said determining means comprises means for providing two numbers in the range from one to six inclusive.

* * * * *